United States Patent [19]

Patrello

[11] Patent Number: 4,541,205

[45] Date of Patent: Sep. 17, 1985

[54] ABRASIVE WHEEL ASSEMBLY

[75] Inventor: Joseph Patrello, Ossining, N.Y.

[73] Assignee: United Abrasives, Inc., Mount Vernon, N.Y.

[21] Appl. No.: 483,148

[22] Filed: Apr. 8, 1983

[51] Int. Cl.[4] ..... B24B 41/04

[52] U.S. Cl. ..... 51/168; 51/209 R

[58] Field of Search ..... 51/168, 209 R, 206 R

[56] References Cited

U.S. PATENT DOCUMENTS

| | | | |
|---|---|---|---|
| 3,081,584 | 3/1963 | Bullard | 51/209 R |
| 3,136,100 | 6/1964 | Robertson, Jr. | 51/209 R |
| 3,210,892 | 10/1965 | Perham | 51/168 |
| 4,015,371 | 4/1977 | Grayston | 51/168 |

FOREIGN PATENT DOCUMENTS

| | | | |
|---|---|---|---|
| 860043 | 9/1940 | France | 51/168 |

OTHER PUBLICATIONS

Article from Foundry Equipment News, Jun. 1980, p. 19.

*Primary Examiner*—Roscoe V. Parker

*Attorney, Agent, or Firm*—St. Onge Steward Johnston & Reens

[57] ABSTRACT

An abrasive wheel assembly for use on a grinding or cut-off machine is described. A hub includes a mounting for releasably mounting the hub on the machine and securing structure for securing the hub to the center of the abrasive wheel so as to prevent axial movement of the hub relative to the abrasive wheel. A transverse key and mating keyway comprise a mechanical interlock to prevent rotation between the hub and the abrasive wheel. The keyway may be formed by imbedding a bushing in the abrasive wheel and may be used with epoxy to further secure the hub to the abrasive wheel rotationally.

1 Claim, 7 Drawing Figures

ABRASIVE WHEEL ASSEMBLY

BACKGROUND OF THE INVENTION

This invention relates to abrasive wheels generally and, more particularly, to abrasive wheel assemblies having an abrasive wheel and a mounting hub for use as grinding or cut-off wheels on portable and stationary machines.

A well-known type of abrasive wheel assembly is commonly known as a depressed center type 27 or type 28 wheel. Typically, such wheel assemblies are used on portable hand-held machines for grinding or cut-off work. In almost all cases, a disposable die cast zinc hub permanently fixed to the abrasive wheel is used to mount the abrasive wheel on a grinding or cut-off machine. The offset of the depressed center of the wheel permits mounting of the hub on the abrasive wheel without protrusion of the mounting means beyond the face of the wheel. The abrasive wheel may be made of woven fiberglas combined with a suitable abrasive.

In such wheel assemblies, there are two mounting requirements for adequately securing the hub to the wheel. One requirement is to provide clamping force; this is accomplished by riveting or spinning a sleeve portion of the hub over a central aperture of the wheel. The second requirement is to secure the hub rotationally; this is normally done by using an epoxy resin between a flange portion of the hub and the raised portion of the wheel defining the offset. Because of the high rotational speeds—8500 rpm or more, depending on wheel diameter—the wheel may fly apart or "explode" if either requirement is not met.

The common reliance on an epoxy mounting of the hub has several weaknesses. The surface preparation, intermixing of the epoxy resin, and amount of epoxy resin are critical to a satisfactory bond. Further, the alignment and balance of the abrasive wheel must be maintained to prevent wheel wobble. Because the epoxy resin is not visible, it is very difficult to determine from an inspection of the wheel assembly whether the hub is secure rotationally. In order to test the epoxy bond for maximum strength, the assembly must be destroyed. Destructive testing of a representative sample is used to minimize the number of defective wheel assemblies which are sold, but not all wheel assemblies with unsatisfactory bonds are located by such testing.

Applicant is aware of several reports of mounting failure of such wheel assemblies and is aware of numerous recalls of wheel assemblies by manufacturers in which particular batches were defective. Applicant tested a representative sample of 75 wheel assemblies manufactured by four of the major suppliers: Bay State of Massachusetts, Brilliant Abrasive of Kansas City, Ace Abrasive of Troy, Ohio, and Carborundum of Niagara Falls, N.Y. Commercially available 9-inch diameter depressed center wheel assemblies were subjected to severe edge and side loading considered to be in excess of that of normal use. In 14 of the 75 samples, the epoxy bond failed in various degrees before the useful life of the abrasive wheel was reached.

Due to the extremely hazardous condition presented by any defect in the epoxy bond between the hub and the wheel, there is a need for an improved mounting of the hub less dependent on an epoxy bond. One attempt to meet this need is a three-pin glueless hub disclosed in Foundry Equipment News magazine, June 1980 at page 19. The proposed pins are longitudinal, dog-like protrusions along the circumference of the hub placed so as to penetrate three corresponding holes in the abrasive material of the wheel. However, the proposed mounting may result in wearing or weakening of the wheel at the three holes penetrated by the pins and requires costly additional manufacturing operations.

It is therefore an object of the present invention to provide an inexpensive abrasive wheel assembly having greater safety than that of a conventional wheel assembly relying on an epoxy bond to secure the hub rotationally. It is a further object of the present invention to provide an abrasive wheel assembly having an improved mounting of the hub to the wheel permitting greater loading and increased useful life of the wheel assembly. It is still a further object of the present invention to provide a hub for an abrasive wheel assembly having improved control over eccentricity and wobble of an abrasive wheel to which it is secured.

SUMMARY OF THE INVENTION

The present invention is directed to a novel abrasive wheel assembly for use on a grinding or cut-off machine.

According to one aspect of this invention, an abrasive wheel and a hub are provided. The hub includes mounting means for releasably mounting the hub on the grinding or cut-off machine. Securing means for securing the hub to the center of the abrasive wheel so as to prevent axial movement of the hub relative to the abrasive wheel is provided. Transverse key means and mating keyway means comprise a mechanical interlock between the hub and the abrasive wheel to prevent rotation between the hub and the abrasive wheel. Although not required, the abrasive wheel assembly may include bushing means including the keyway means and may include an epoxy resin for further securing the hub to the abrasive wheel.

According to a second aspect of this invention, a hub for mounting upon the back of an abrasive wheel to form an abrasive wheel assembly for use on a grinding or cut-off machine is provided. The hub includes mounting means for releasably mounting the hub upon the grinding or cut-off machine. A first flange extends radially outward from the mounting means for abutment with the back of the abrasive wheel to facilitate alignment of the abrasive wheel. An axial extension for penetrating a central aperture in the abrasive wheel is adapted to provide a second flange extending radially outward along the front of the abrasive wheel so as to secure the hub to the wheel axially by clamping the abrasive wheel between the flanges. Key means on the hub extending transversely relative to the axis of the hub is provided to secure the hub to the abrasive wheel rotationally.

The invention, together with further objects and attendant advantages, will be best understood by reference to the following detailed description of the preferred embodiment taken in conjunction with the accompanying drawings.

DESCRIPTION OF THE PREFERRED EMBODIMENT

Figure 1:
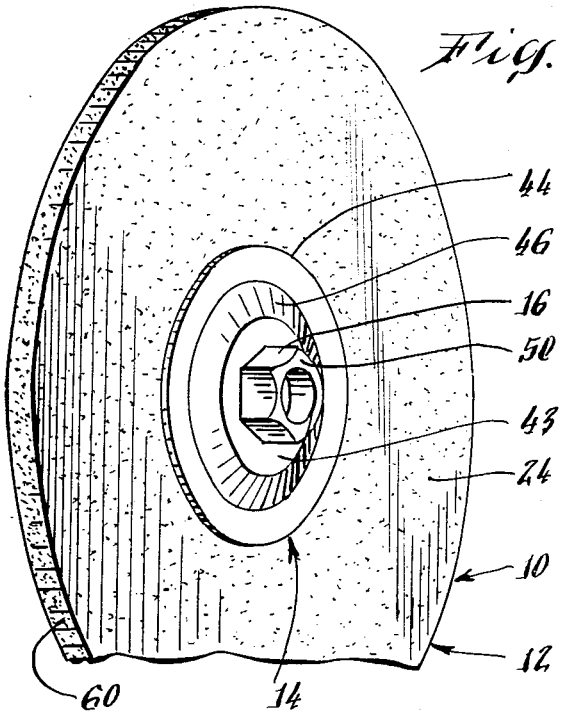
FIG. 1 is a perspective view of an abrasive wheel assembly made in accordance with the present invention.

Turning now to the drawings, FIG. 1 shows an abrasive wheel assembly, indicated generally by the numeral 10, made in accordance with this invention. The wheel assembly 10 includes a disc-shaped abrasive wheel, indicated generally by the numeral 12, and a hub, indicated generally by the numeral 14, fixed to the center thereof. A nutlike hub portion 16 has a hexagonal configuration to provide wrench flats to facilitate mounting and unmounting of the wheel assembly 10 upon a grinding or cut-off machine, not shown.

Figure 2:
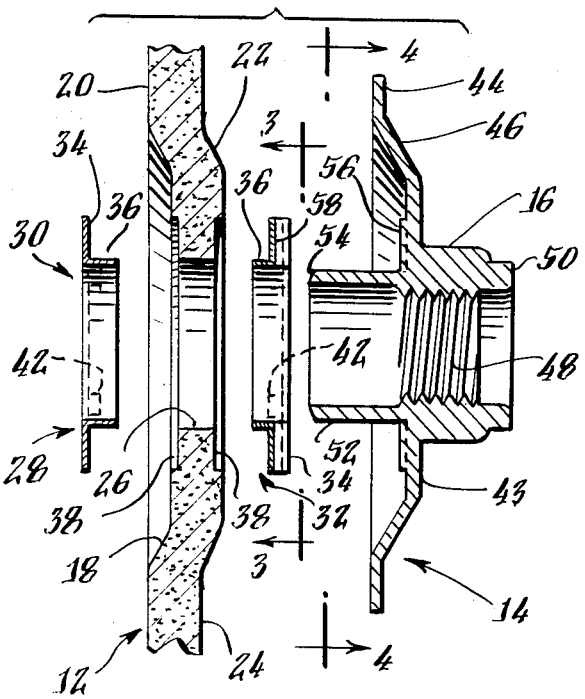
FIG. 2 is an exploded view of portions of the wheel assembly of FIG. 1, in elevation, showing the hub and the abrasive wheel in section.

As indicated in FIG. 2, the abrasive wheel 12 has a central dished portion 18 within a front or face portion 20 opposite the hub 14. A corresponding central raised portion 22 is provided on a back portion 24 of the abrasive wheel 12. This configuration results in an off-set of a central aperture 26 with respect to the circumference of the abrasive wheel 12 to ensure that the hub 14 does not protrude beyond the face portion 20 and interfere with a workpiece of the grinding or cut-off machine upon which the wheel assembly 10 is mounted. The back portion 24 is not used for grinding and may be covered with a paper backing sheet identifying the composition and dimensions of the abrasive wheel 12.

A split bushing, indicated generally by the numeral 28, provides reinforcement of the central aperture 26 of the abrasive wheel 12 and results in a precise configuration for mounting the hub 14. The split bushing 28 includes front and rear bushings, indicated generally by the numerals 30 and 32, respectively, which become embedded in the abrasive wheel 12 from opposite sides during assembly so as to form an eyelet. The bushings 30 and 32 include disc-shaped flange portions 34 extending radially outward from one end of cylindrical sleeve portions 36 having outside diameters corresponding to the central aperture 26 so as to be closely received therein. The bushings 30 and 32 may be made of any suitable bushing material and, for example, may be conveniently stamped of mild steel having a thickness of 0.015 inches.

The abrasive wheel 10 may include alternating layers of woven fiberglas reinforcement and an abrasive material rigidly held together by a phenolic bond or other bond of a suitable resin. Typically, the abrasive wheel 10 includes three or four layers of woven fiberglas having a mixture of resin and aluminum oxide, silicon carbide, or other suitable abrasive material therebetween. This configuration is initially flat and somewhat moist with the resin; the dished portion 18, the raised portion 22 and annular recesses 38 for the flange portions 34 are not yet formed. The bushings 30 and 32 and the flat configuration are pressed together at room temperature to give the abrasive wheel 12 its final shape and density. During this pressing operation, the flange portions 34 of the bushings 30 and 32 penetrate the surface of the abrasive wheel 12 to form the annular recesses 38.

Figure 3:
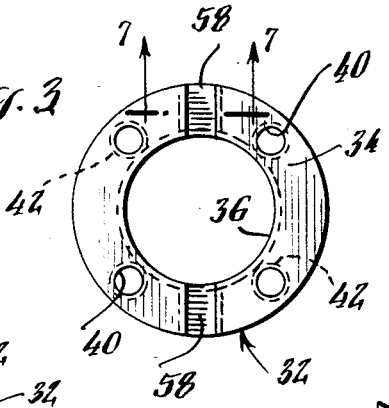
FIG. 3 is an elevational view of the rear bushing of the wheel assembly as indicated by the line 3—3 of FIG. 2.
Figure 6:
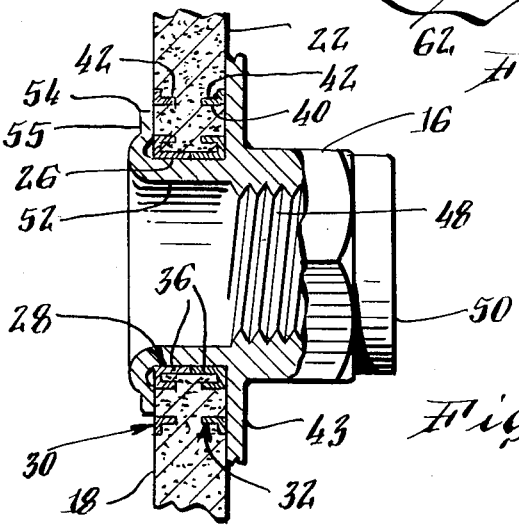
FIG. 6 an enlarged sectional view of the wheel assembly of FIG. 1 taken along a diameter rotated 45° from the section 1 of FIG. 5.

As shown in FIG. 3, each of the bushings 30 and 32 includes four pierced apertures 40 which are equally spaced along the disc-shaped portion 34. The pierced apertures 40 provide irregular sleeve-like protrusions 42, as shown in FIG. 6. The protrusions 42 penetrate the abrasive wheel 12 during the pressing operation to improve the adhesion of the bushings 30 and 32 to the abrasive wheel 12 and serve to mechanically lock the bushings 30 and 32 against rotational movement relative to the abrasive wheel 12. As a result of this method of construction, the bushings 30 and 32 are precisely aligned relative to the face portion 20 of the abrasive wheel 12 to provide an accurate mounting for the hub 14.

Figure 5:
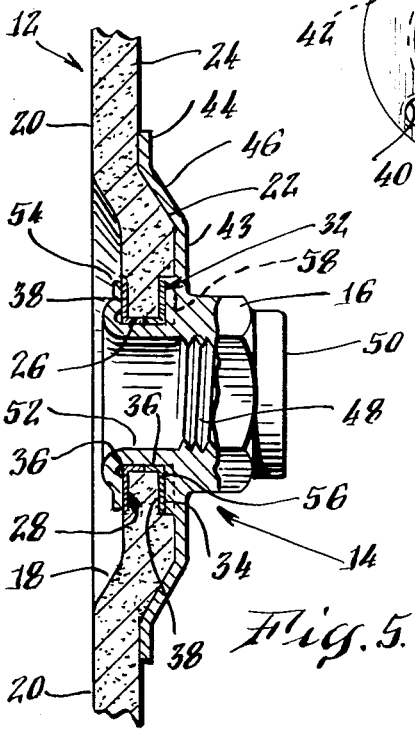
FIG. 5 is a sectional view of the wheel assembly of FIG. 1 similar to the exploded view of FIG. 2.

As shown in FIG. 2, the hub 14 includes a flange 43 having an alignment surface 44 along its circumference for bearing upon the back portion 24 of the abrasive wheel 12 upon assembly to the abrasive wheel 12. A dished portion 46 of the hub 14 corresponds to the raised portion 22 of the abrasive wheel 12 so as to provide a narrow space therebetween, as shown in FIG. 5. An internal thread 48 provides a mounting means for removably mounting the wheel assembly 10 upon the grinding or cut-off machine. A right- or left-hand thread may be provided to ensure that applying a workpiece to the rotating wheel causes tightening of the hub 14 against the machine. A disc-shaped bearing surface 50 facilitates mounting of the hub 14 upon the machine.

The hub 14 has a central sleeve portion 52 extending coaxially with respect to the internal thread 48 for closely receiving the bushings 30 and 32. The sleeve 52 includes a deformable rim 54 which may be riveted, staked or spun outward and backward against the front bushing 30 to form a flange 55 to provide a clamping force holding the alignment surface 44 of the hub 14 tightly against the back portion 24 of the abrasive wheel 12. The hub 14 may be conveniently made as a zinc or aluminum die casting and may be machined along the alignment surface 44 and other critical surfaces to provide accurate alignment of the abrasive wheel 12 upon the hub 14 to prevent wobble or imbalance.

Figure 4:
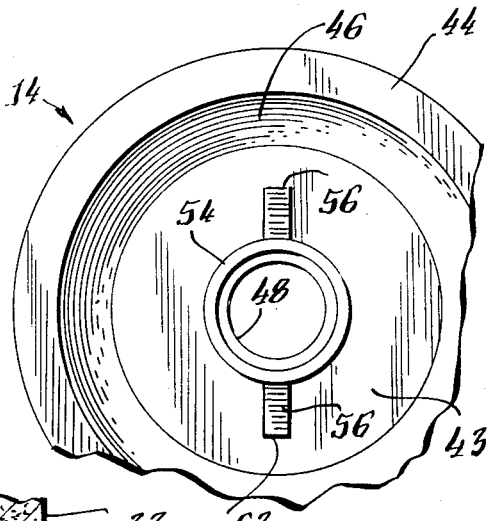
FIG. 4 is an elevational view of the hub of the wheel assembly as indicated by the line 4—4 of FIG. 2.

A particular feature of the present invention is a raised key portion 56 of the hub 14 closely received within a mating keyway portion 58 of the rear bushing 32. This mechanical interlock between the hub 14 and the abrasive wheel 12 prevents rotational movement therebetween. In the preferred embodiment shown, the key portion 56 extends radially outward from the sleeve portion 52 as two diametrically opposed rectangular elevations of the flange 43, as shown in FIGS. 2 and 4. The key portion 56 extends between the inner and outer diameter of the disc-shaped flange portion 34 of the rear bushing 32. The keyway portion 58 of the rear bushing 32 is recessed at two diametrically opposed locations of the flange 34 corresponding to the key portions 56.

Figure 7:
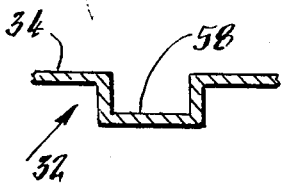
FIG. 7 an enlarged sectional view of the rear bushing of the wheel assembly as indicated by the line 7—7 of FIG. 3.

Preferably, the recessed keyway portion 58 is a channel of rectangular cross-section, as shown in FIG. 7, corresponding to a rectangular cross-sectional configuration of the key portion 56 so as to provide a positive interlock to secure the hub 14 rotationally. In the preferred embodiment shown, the raised key portion 56 has a width of 0.125 inches and a height of 0.034 to 0.039 inches with corners having a maximum radius of 0.004 inches. The radially outward edges of the key portion 56 may be cast or machined so as to be tangent to a circle having a diameter slightly smaller than the outside diameter of the rear bushing 32. The recessed keyway portion 58 has a channel width of 0.135 to 0.140 inches, a channel depth of 0.040 to 0.045 inches, and a maximum corner radius of 0.004 inches to avoid interference with the key portion 56 while providing a close fit thereto.

The mechanical interlock provided by the key portion 56 and the recessed keyway portion 58 is suitable for mounting a wide variety of grinding and cut-off wheels. Because the key portion 56 interlocks the metal bushing at the center of the abrasive wheel 12 rather than the unreinforced abrasive material portion of the wheel, there is no resulting weakening of the abrasive wheel 12. This effectively overcomes the difficulties of the three-pin glueless mounting described above. Furthermore, the configuration of the present invention results in the formation of a keyway penetrating the abrasive material of the abrasive wheel 12 as part of the pressing operation; a separate drilling or punching operation is not required.

The hub 14 may be used on grinding and cut-off wheels of any diameter and is suitable for abrasive wheels of various thicknesses such as, for example, a thin abrasive wheel providing a narrow cylindrical cutting edge 60. In such applications, the sleeve portion 36 of the bushings 30 and 32 may be shortened or lengthened to correspond to the thickness of the abrasive wheel 12. Similarly, the abrasive wheel assembly 10 is suitable for flat abrasive wheels. Because the flange 55 protrudes only slightly above the surface of the front bushing 30, there is little need for the offset provided by the dished portion 18 and the raised portion 20 for many applications.

Preferably, the mechanical interlock provided by the key portion 56 and the keyway portion 58 is combined with an epoxy bond mounting to provide added rotative strength and provide a backup system to prevent rotation of the abrasive wheel 12 relative to the hub 14 if the epoxy bond were to fail. The narrow space between the dished portion 18 of the hub 14 and the corresponding raised portion 22 of the abrasive wheel 12 is well suited to the application of an epoxy resin to bond the hub 14 to the abrasive wheel 12. This space is carefully controlled to ensure that a predetermined amount of epoxy resin fills the space without creating imbalance of the wheel assembly 10.

Applicant has tested numerous abrasive wheel assemblies made in accordance with the present invention under the same severe testing conditions applied to the 75 representative abrasive wheel assemblies of current design described above. Despite the severe side and edge loading to which the abrasive wheels were subjected, Applicant observed no separation of the epoxy resin or other failure in the mounting of the hub 14 to the abrasive wheel 12. In each case, Applicant was able to utilize the full useful life of the abrasive wheel 12 without any measurable risk that the hub 14 would break away from the abrasive wheel 12 either axially or rotationally.

Although the preferred embodiment shown employs a key portion 56 having a substantially rectangular configuration extending transversely along a diameter of the hub 14, it should be readily apparent that the key portion 56 and the mating recessed keyway portion 58 may be of other configurations providing the desired mechanical interlock. For example, instead of the two diametrically opposed key elements shown, any number of key elements may be used, there being certain advantages in a symmetrical placement to balance loading. Similarly, the key portion 56 and the keyway portion 58 may be of other configurations in area and cross-section than those of the preferred embodiment. The key portion 56 need not be directed radially, and other orientations may be employed with similar effect. Also, the locations of the key portion and the keyway portion may be reversed by providing the key portion on the rear bushing 32 and the keyway portion on the hub 14, the essence of the present invention being the mechanical interlock provided between the hub 14 and the abrasive wheel 12.

From the foregoing, it should be apparent that the present invention provides an inexpensive abrasive wheel assembly having greater safety than that of a conventional wheel assembly relying on an epoxy bond to secure the hub rotationally. The improved mounting means of the hub of the present invention permits greater loadings on the abrasive wheel and increased useful life as well as improved control over eccentricity and wobble of the abrasive wheel.

Of course, it should be understood that various changes and modifications to the preferred embodiment described above will be apparent to those skilled in the art. For example, the configurations and placement of the key portion 56 and the keyway portion 58 may be changed without adversely affecting the mechanical interlock between the hub 14 and the abrasive wheel 12. Similarly, the hub 14 may be mounted to the abrasive wheel 12 without the use of an epoxy bond as an additional means of securing the hub rotationally. Such changes and modifications can be made without departing from the spirit and scope of the present invention, and it is therefore intended that such changes and modifications be covered by the following claims.

What is claimed is:

1. An abrasive wheel assembly for use on a grinding or cut-off machine comprising:

an abrasive wheel having a central aperture extending from a face portion of the wheel to a back portion of the abrasive wheel;

bushing means including a sleeve portion received within the central aperture of the abrasive wheel to provide a reinforced opening, a first flange extending radially outward from the sleeve portion along the face portion of the abrasive wheel, and a second flange extending radially outward from the sleeve portion along the back portion of the abrasive wheel, the second flange providing at least one radially directed flat slot extending from the reinforced opening to a periphery of the second flange; and a hub having mounting means for releasably mounting the hub upon the machine, a third flange extending radially outward from the mounting means for abutment with the back portion of the abrasive wheel for facilitating alignment of the abrasive wheel, an axial extension received within the reinforced opening in the abrasive wheel, clamping means engaging the first flange to secure the hub to the abrasive wheel axially and a raised key portion extending radially relative to the axis of the hub in engagement with the flat slot of the bushing at a distance radially spaced outwardly from the axial extension to prevent rotation of the hub relative to the abrasive wheel.

* * * * *